US006431103B1

(12) United States Patent
Meyerdierks

(10) Patent No.: US 6,431,103 B1
(45) Date of Patent: Aug. 13, 2002

(54) WINCH

(76) Inventor: Helmut Meyerdierks, In der Groll 26, 45721 Haltern (DE)

( * ) Notice: Subject to any disclaimer, the term of this patent is extended or adjusted under 35 U.S.C. 154(b) by 0 days.

(21) Appl. No.: 09/765,071

(22) Filed: Jan. 18, 2001

(30) Foreign Application Priority Data

Jan. 18, 2000 (DE) ..... 200 00 724 U
Dec. 18, 2000 (EP) ..... 00710043

(51) Int. Cl.[7] ..... B63B 21/16; B66D 1/12

(52) U.S. Cl. ..... 114/218; 254/339; 254/342; 254/353; 254/354; 254/362; 254/369; 254/376

(58) Field of Search ..... 114/218; 254/266, 254/339, 342, 345, 352, 353, 354, 362, 369, 376

(56) References Cited

U.S. PATENT DOCUMENTS 1,554,634 A * 9/1925 Kersting ..... 254/339
2,826,939 A * 3/1958 Dever ..... 226/194
3,042,375 A * 7/1962 Fahey et al.
3,411,751 A * 11/1968 Pooley, Jr. ..... 254/342
3,841,606 A * 10/1974 Declercq ..... 114/218
3,968,953 A * 7/1976 Guangorena ..... 254/342
3,985,340 A * 10/1976 Guangorena ..... 254/344
4,084,793 A * 4/1978 Gardiner ..... 192/45
4,231,551 A * 11/1980 Ikeda ..... 254/344
5,088,693 A * 2/1992 Brenot ..... 254/344
5,370,366 A * 12/1994 Ottemann ..... 254/343
5,593,140 A * 1/1997 van Beers ..... 226/193
5,927,691 A 7/1999 Ottemann
6,070,858 A * 6/2000 Hase et al. ..... 254/342

FOREIGN PATENT DOCUMENTS

DE 425 951 2/1926
DE 25 05 053 A1 8/1976
FR 767 178 7/1934

OTHER PUBLICATIONS

Harken Yacht Equipment brochure, 1995, Harken, Pewaukee, Wisconsin, USA, pp. 166–183.

* cited by examiner

*Primary Examiner*—Sherman Basinger
(74) *Attorney, Agent, or Firm*—Akerman Senterfitt

(57) ABSTRACT

A motor winch, which is suitable as a sheet or halyard winch (11) for sailing yachts, etc., has an integrated electric or hydraulic drive. The motor (52) is integrated into the winch in such a way that it is located within the winch body and in particular within the winch drum (16). The motor brings about rotation of the winch drum through a multistage gear located in the winch foot (22), optionally assisted by an epicyclic gear (54). A manual operation with a winch crank is made possible by a winch crank nut (32) in the winch head (29). The manual driving shaft is past the somewhat eccentrically positioned motor. A reverse rotation or veering function can be provided in which following the disconnection of the drum locking mechanism, the motor is rotated back in braking manner with a controlled speed.

19 Claims, 8 Drawing Sheets

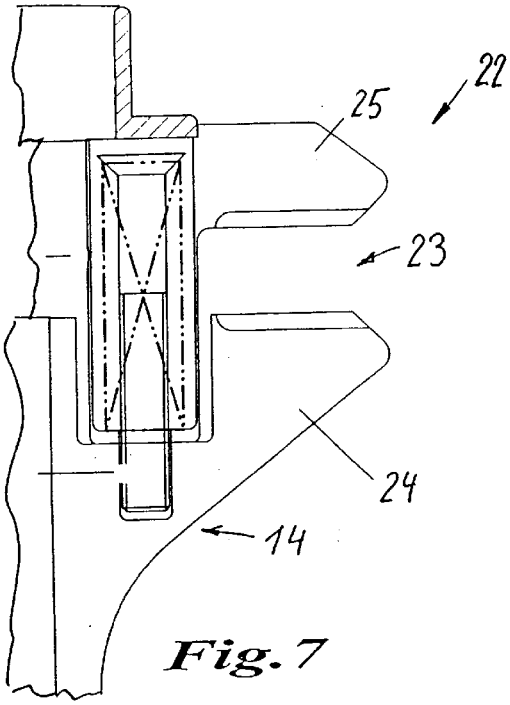
Fig. 7
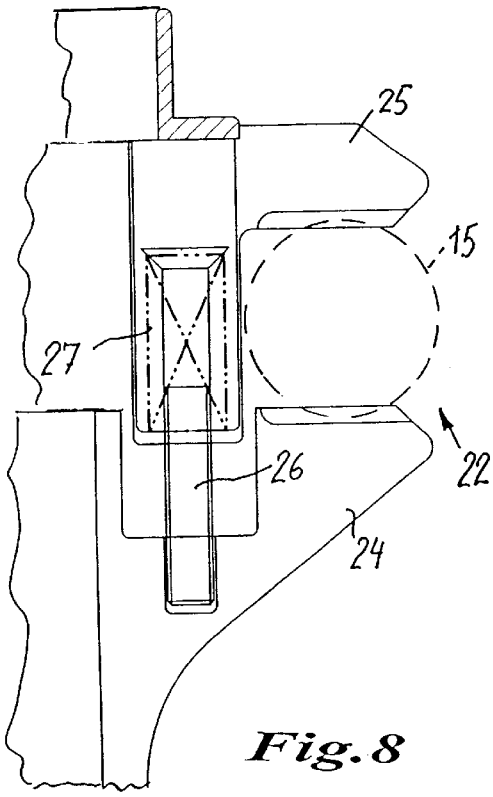
Fig. 8
Fig. 12
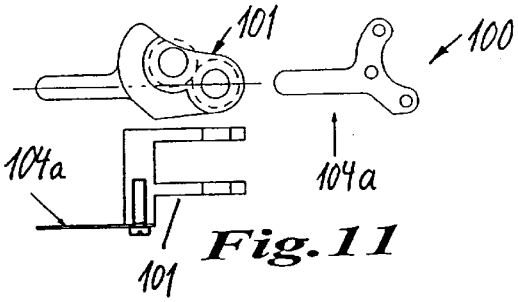
Fig. 11
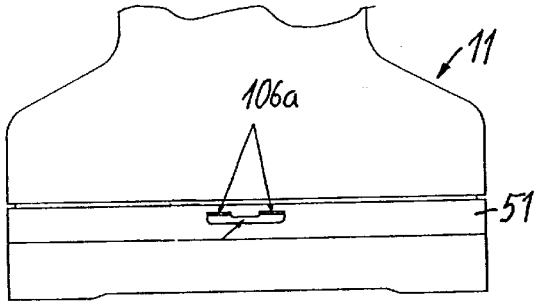
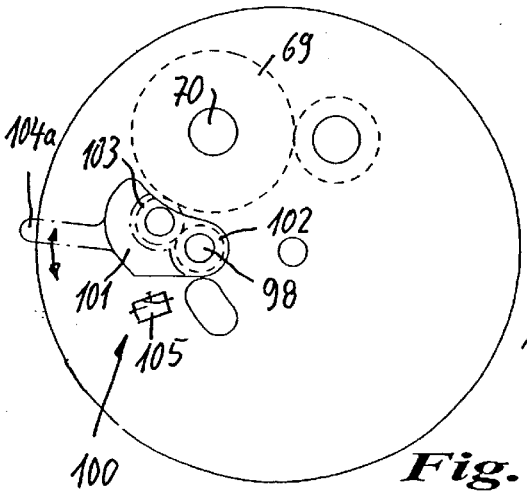
Fig. 13
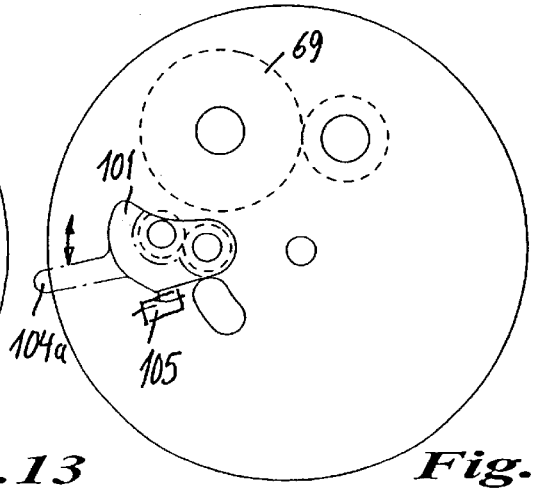
Fig. 14

WINCH

BACKGROUND OF THE INVENTION

The invention relates to a winch for ropes, particularly for running rigging, such as halyards and sheets on sailing vessels. Such winches normally have a winch drum rotatable in a hauling direction, which is fitted to a base part such as a winch foot or base mounted e.g. on a boat deck. The winch drum is driven by means of a winch gear.

Winches driven by hydraulic or electric motors are already known, e.g. from the brochure HARKEN Yacht Equipment 1995 of HARKEN Piwaukee, Wis., USA, pp 166–183. The motors are flanged to the underside of the winches, which leads to the disadvantage that the motor gear unit must be installed under the deck and the deck area is weakened by a relatively large opening for the passage of the driving shaft flange. Frequently the necessary space is not available at the most favourable point for installing the winch and the motor is a hindrance in the passage to the aft cabins or the interior of the sailing yacht. Even in the case of a costly lining of the motor gear unit the head space is frequently impaired, which constitutes a particular accident risk when at sea. The fitting of such a motor winch to a mast for operating the halyards is scarcely possible.

OBJECT OF THE INVENTION

The object of the invention is to create a very compact motor winch, which largely obviates limitations with respect to the installation locations.

SUMMARY OF THE INVENTION

This object is solved by a winch having the features of claim 1.

As a result of the completely integrated fitting of the motor within the winch body, which need not be any larger than a manually operable winch, all restrictions concerning the installation location are obviated. The winch can be located at the point ensuring the least troublesome run of the ropes to be operated by it such as halyards or sheets and where it is least in the way on the deck. It is merely necessary to lay the supply ropes, which can normally take place between the deck structure and a top covering of the cabin. The fitting to the mast is also possible with a conventional winch bracket.

In the case of a construction with an electric motor there is a control unit with a power contactor, which is controlled by means of a weak current control circuit by an operating switch on the deck. The control can also incorporate an excess current fuse protection similar to an automatic cutout, which in addition to the protection function serves to limit a maximum tensile force or pull. Due to the proportionality between the pull and the power consumption even in the case of an accidental excessively long operation, it is possible to prevent overloading of the rope or the sail connected thereto.

When reference is made hereinbefore to ropes, this covers all elongated, flexible pulling or tension elements, which can be placed around a winch drum.

The motor is preferably located in a tubular supporting body and can be installed there with a rotation axis parallel to the winch axis. The tubular supporting body on which the winch drum can be installed by means of needle bearings, constitutes at the same time a both light and stable support structure for the winch drum and leads to a good transfer to the winch foot of the considerable rope forces acting on the winch.

The winch preferably has an additional manual drive, such as in the case of mechanical winches, by means of which it is possible to operate a winch crank insertable in the upper winch head. For this purpose the driving shaft can project eccentrically through the motor area and can also run by the somewhat eccentrically positioned motor.

To enable the motor winch to also haul a rope with the free end in passage operation without mechanical intervention by an operator for tightening the rope, use can be made of a per se known selftailing device, which forms the head of the winch drum and into which the rope is introduced by means of a guide device. Preferably the width of the gripping groove is variable to permit adaptation to different rope diameters, the lower groove boundary possibly being an upper flange of the winch drum and the upper groove boundary is a resiliently axially movable circular disk.

The motor can be a geared motor with an integrated motor gear, e.g. an epicyclic gear, which forms a gear prestage. The motor is preferably a direct current shunt-wound motor, which has a very favourable speed/torque characteristic for the present case, i.e. its torque increases with decreasing speed. Through a high idling speed of approximately 14,000 revolutions per minute, high power can be supplied for a small size. The gear prestage reduces this speed by 3 to 5 times, so that in the following winch gear stages with a lower toothed wheel numbers the sought winch drum idling speed of approximately 80 to 100 revolutions per minute can be achieved. In the case of a winch drum diameter of approximately 100 mm, this leads to a rope hauling speed of between 25 and 30 meters per minute, which is ideal for uses on yachts.

The winch gear and motor gear are preferably non-self-locking spur gears, which have a very high efficiency compared with the conventionally used worm gears. This more particularly applies if in preferred manner the winch gear runs in the oil bath, which can be made permanently maintenance-free by corresponding lubricants. This obviates the need for time-consuming, difficult periodic winch maintenance on board.

The winch gear is preferably located in the foot and contains three gear planes, which in each case form a gear stage. They can be constructed from at least two disk-like, stacked blanks and one of the blanks can be formed by the supporting body for the winch drum. Preferably the transmission direction is from bottom to top, i.e. the motor shaft projects through to the end of the winch base and the individual gear stages are built up above it, so that then the final gear stage reaches and can drive with a transmission toothed wheel the inner edge of the winch drum.

Freewheel locking mechanisms prevent a reversal of the winch drum and at the same time ensure that in the case of motor drive there is no concomitant rotation of the manual drive train, so that an accidentally fitted winch crank cannot give rise to accident risks. Advantageously a freewheel mechanism disconnects the motor in the case of manual operation, so that it does not have to be concomitantly rotated.

The known motor-driven winches are exclusively provided for hauling a rope, i.e. for conveying in one direction. However, there is often a need for veering or easing away a rope, i.e. loosening it somewhat in controlled manner. This is in particular necessary for trimming the sails. According to a preferred embodiment of the invention the winch can be provided with a veering means, which contains an electric control mechanism with which the tensioned rope can be loosened. The electric motor can be used as a controlled brake.

Since as a result of the running back of the winch drum and therefore the drive, the manual drive cannot simply be disconnected by means of a freewheel mechanism, in this case the manual drive is preferably engaged by means of a manually operable clutch.

To be able to perform a reversal of the winch drum counter to the hauling direction, the winch drum freewheel mechanism must be disconnected. This can take place by electrical operation, e.g. by electromagnets or electric servomotors, which disengage the retaining pawls of the freewheel mechanism during the reversing process and maintain same there. As the retaining pawls are normally braced if the winch is under the tension of the rope, said bracing effect can be eliminated in that the motor is firstly moved somewhat in the hauling direction, e.g. by a fraction of the amount corresponding to a locking mechanism division and then the pawls are disengaged. If then the winch drum rotates back under the tension of the rope, the motor also runs backwards. On reaching a preset return speed, which can be monitored by means of a revolution indicator, the control device can connect in a braking resistance means, which limits the reverse speed by the motor now running as a motor brake. Said electric braking resistance means need not be made too large, because the reversing function is normally limited to a limited release.

Said novel veering device, which is also advantageous for other motor winch types, is operated by a switch knob independent of the operating switch for hauling. However, it is also possible to use other control devices, e.g. a joystick. After veering the rope and releasing the operating switch the control device for reengaging the winch drum freewheel mechanism can control the motor briefly in the hauling direction again until the winch drum is almost stationary or runs somewhat in the hauling direction, so as to avoid an excessively hard engagement of the retaining pawls following the release thereof.

If during easing away the rope runs counter to the hauling direction, it could arise that it runs out of the selftailing device. Thus, preferably there is a resilient hold-back lever on the selftailing device and behind which the rope is placed and which is at a considerable circumferential distance from the guide device, i.e. the guide finger, which raises the rope from the winch drum into the selftailing groove. Thus, the rope is guided on both sides of the selftailing groove and acts in both direction. This novel hold-back lever is also advantageous for other winches with a reversing function.

The rope is maintained on the outer surface of the winch drum by friction with self-amplification, i.e. the initial rope tension applied by the selftailing device is amplified by several coils of the rope over the winch drum. Conventional winch drums are roughened or knurled on the outside for increasing the friction factor, but this is not very protective of the rope and damages the surface thereof. It is already known to provide the winch drum with numerous, uniformly circumferentially distributed longitudinal ribs. Within the scope of the invention it has been found that for winches of all types a particularly good ratio between the retaining force and rope protection can be achieved if the longitudinal ribs are provided pairwise with a relatively large, mutual circumferential spacing. There is then an alternation of a few closely juxtaposed ribs with large circumferential spacings, e.g. on the circumference four groups of in each case two closely juxtaposed ribs. As a result the rope is brought into a relatively pronounced polygonal shape, obviously with rounded sides, which ensures a good force transfer in the case of lower rope stressing.

These and further features can be gathered from the claims, description and drawings and the individual features can be implemented singly or in the form of subcombinations in an embodiment of the invention and in other fields and can represent independently protectable constructions for which protection is hereby claimed. The subdivision of the application into individual sections and the subheadings in no way restrict the general validity of the statements made thereunder.

BRIEF DESCRIPTION OF THE DRAWINGS

Embodiments of the invention are represented in the attached drawings, wherein show:

FIGS. 7 and 8 A detail in circle VII–VIII in FIG. 2.

FIGS. 11 to 14, 15 to 18 and 19 to 22 In each case three variants of a switching mechanism for manual operation.

DETAILED DESCRIPTION OF PREFERRED EMBODIMENTS

Figure 1:
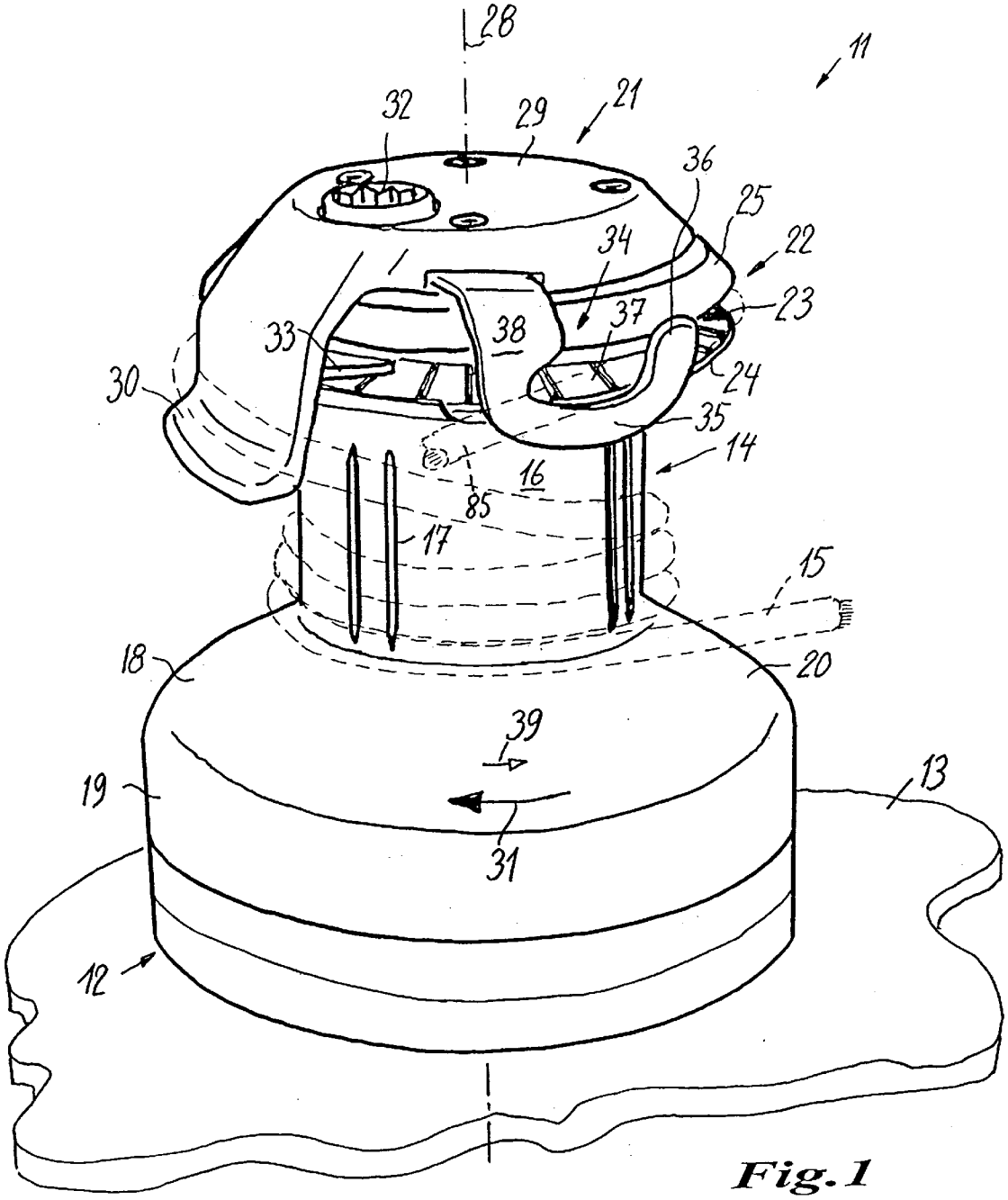
FIG. 1 A perspective view of a winch according to the invention associated with an electric circuit diagram.

FIG. 1 shows a winch 11 for hauling and passing through ropes, e.g. sheets or halyards of sailing vessels. It is fitted by a winch foot or base 12 to the deck 13, cockpit sill or usually, by means of a bracket, to a mast.

A rope 15 shown in broken line form is placed in several coils from bottom to top around a winch drum 14. The winch drum comprises a substantially cylindrical or slightly conical winch drum face 16, on which with a large circumferential spacing groups of two substantially vertical ribs 17 extend to the outside. They can also be slightly inclined in accordance with the entry and rope guidance characteristics.

To the winch drum face 16 is connected at the bottom a bell-shaped winch drum base 18, which has a much larger diameter than the winch drum 16 and whose downwardly inclined connecting surface forms between the lower cylindrical part 19 and the winch drum face 16 an entry guide face 20 for the rope 15. The cylindrical part 19 engages over the offset upper portion of the winch foot 12 and forms together with the latter a cylindrical body.

The upper, free end of the winch is formed by a winch head 21 incorporating a selftailing device 22. The latter is formed by a circumferential gripping groove 23 which, as can in particular be gathered from FIGS. 7 and 8, has a variable groove width. The two groove-bordering gripping bodies are on the one hand formed by a flange 24 at the upper end of the winch drum and on the other by a circular disk 25, which is movably guided towards the winch axis 28 by means of guide bolts 26 and is pressed by compression springs 27 into the position shown in FIG. 7 with the smallest gripping groove 23.

FIG. 1 shows that following its final coil round the winch drum 16, the rope is guided by means of a guide finger fitted to a winch cover 29 covering the top of the winch and which forms a rope guide device 30 and is subsequently introduced into the gripping groove 23, which in accordance with the particular rope thickness is automatically set counter to the tension of the compression spring 27 and engagement of the rope takes place under this compressive force. As the smallest diameter of the circumferential gripping groove is somewhat larger than the winch drum diameter, during the rotation of the drum in the hauling direction (clockwise) the rope exerts a tensile force thereon, so that the rope coils passed round the winch drum are drawn tightly around the latter and driven by it. With increasing loading they are ever more firmly tightened round the drum and, optionally assisted by a slight conicity, are also pressed on one another and against the entry guide face 20. As a result the winch can protectively transfer high rope forces.

Figure 23:
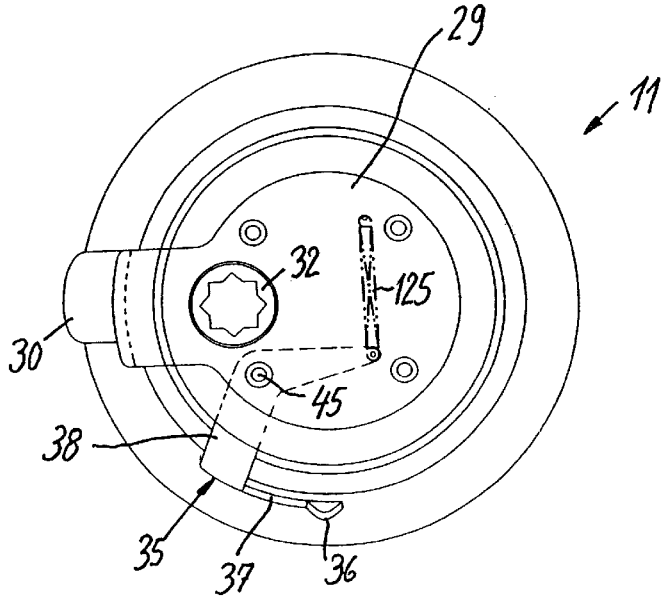
FIG. 23 A plan view of the winch head.

Eccentrically displaced with respect to the winch axis 28, the winch cover 29 contains a winch crank nut 32, in which can be inserted a conventional winch crank for manual operation. Whereas normally the rope performs in the gripping groove almost a complete revolution up to just before the guide device, where it is ejected from the groove by an ejector 33, in another embodiment described relative to FIGS. 10 to 23 it is appropriate to have a retaining device 34 with a retaining lever 35. As is shown in FIG. 23, the retaining lever 35 is pivotable in the winch cover about an axis parallel to the winch axis 28 and formed by cap screws 45 and is resiliently movably mounted by a spring 125 and has a hook shape engaging beneath a rope 15 passing out of the gripping groove. A retaining nose 36 keeps the rope in the gripping groove, whilst it is removed from the latter through the hook opening 37 and the hook shank 38 connected thereto. This retaining device ensures that in a manner to be described hereinafter during veering, i.e. in a winch drum rotation in the veering direction 39 (counterclockwise), the rope is not ejected from the gripping groove.

Figure 2:
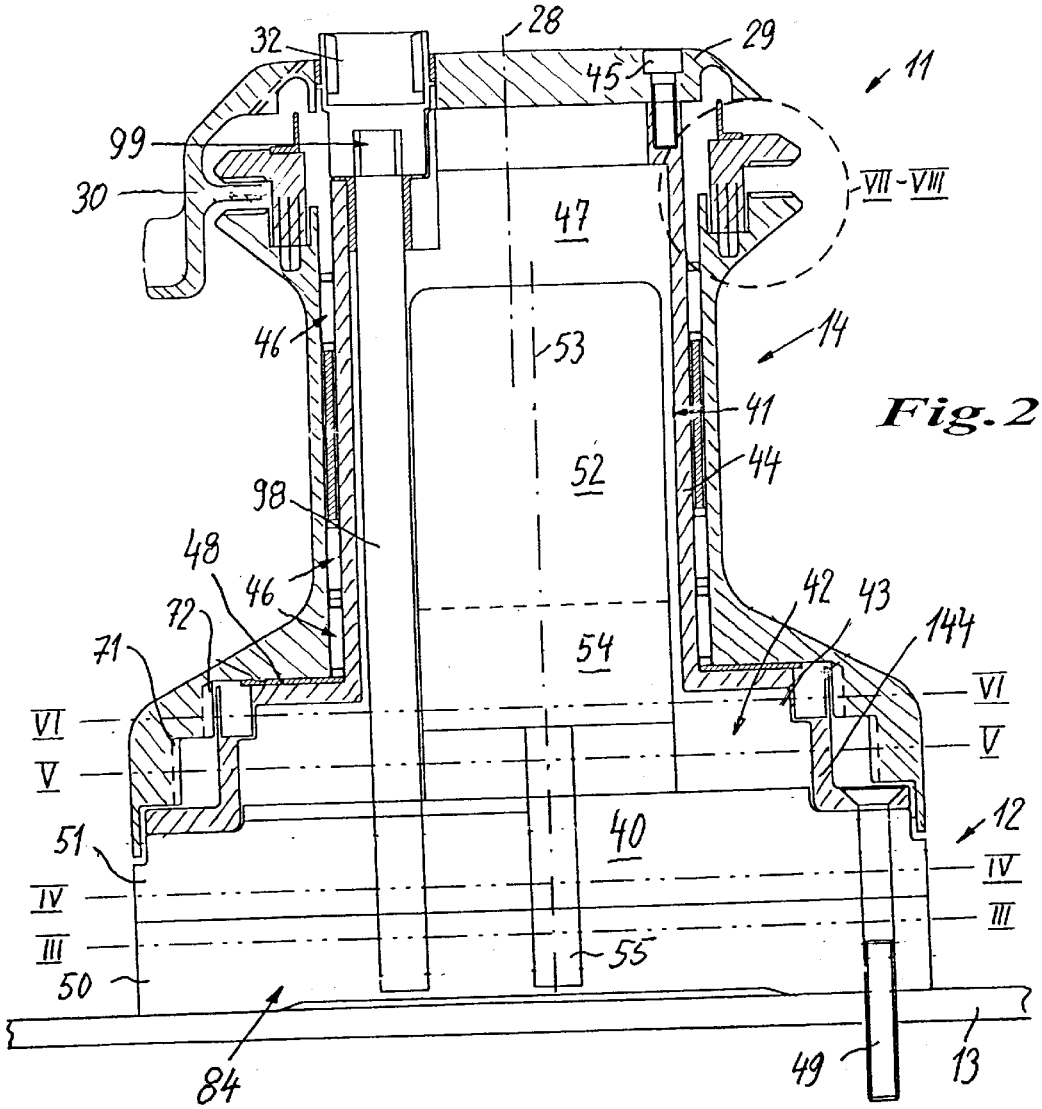
FIG. 2 A diagrammatic longitudinal section through the winch.

FIG. 2 shows the internal structure of the winch with its gear 84 in conjunction with FIGS. 3 to 6 representing the individual gear planes or stages. The winch foot 12 is formed from two superimposed gear blanks 50, 61, which form a two-part gear area 40 which is closed and sealed to the outside and to the remaining winch interior and which receives an oil bath ensuring gear lubrication.

Above the blanks is placed a winch supporting body, which is in the form of a thin tube with a cylindrical portion 41, a somewhat widened area 43 for the third gear stage and a flange 144. On the upper free end is provided an inner flange into which projects screws 45, which retain the winch head 29 or cover plate.

The winch drum 14 is mounted on the cylindrical portion 41 of the supporting body 44 by means of needle bearings 46 and specifically in its upper and lower portions. This leads to a very good force transfer with limited material expenditure. The plastic friction disk 48 absorbs the rope tensile forces acting downwards on the winch drum. Screws 49 passing through the flange 43 of the supporting body 44 and the two gear blanks 50 serve to fix the winch to the deck 13.

The tubular, cylindrical portion 41 of the supporting body 44 surrounds an also cylindrical motor area 47 extending from the upper gear blank 51 to the winch head 21 and which contains an electric geared motor 52. It has an elongated shape and is arranged in the motor area 47 with a motor axis 53 parallel to the winch axis 28 and in somewhat eccentrically displaced manner, being flanged on the upper gear blank 51.

The motor 52 is a shunt-wound direct current motor which, when idling, achieves very high speeds of up to 14,000 r.p.m. and reduces same by an internal epicyclic gear 54 to approximately 4,000 r.p.m. On loading the speed decreases when the torque increases. This is desirable, because both when using as a sheet winch and as a halyard winch, following the initial hauling through of the slack, the final complete hauling must not take place too rapidly.

Figure 3:
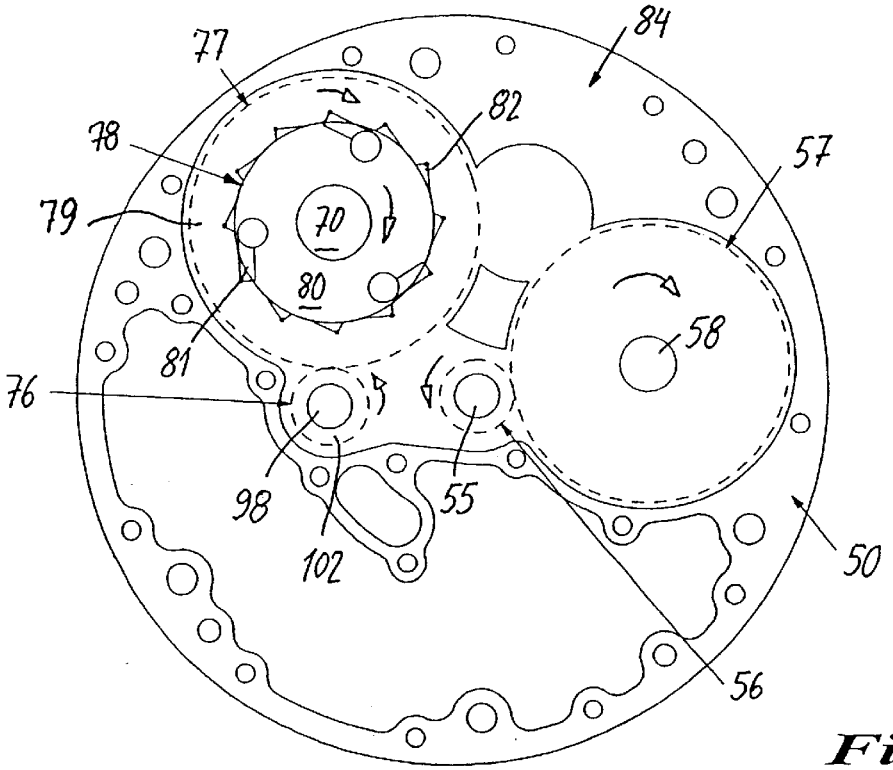
FIGS. 3 to 6 Diagrammatic cross-sections along section lines III—III VI—VI in FIG. 2.
Figure 4:
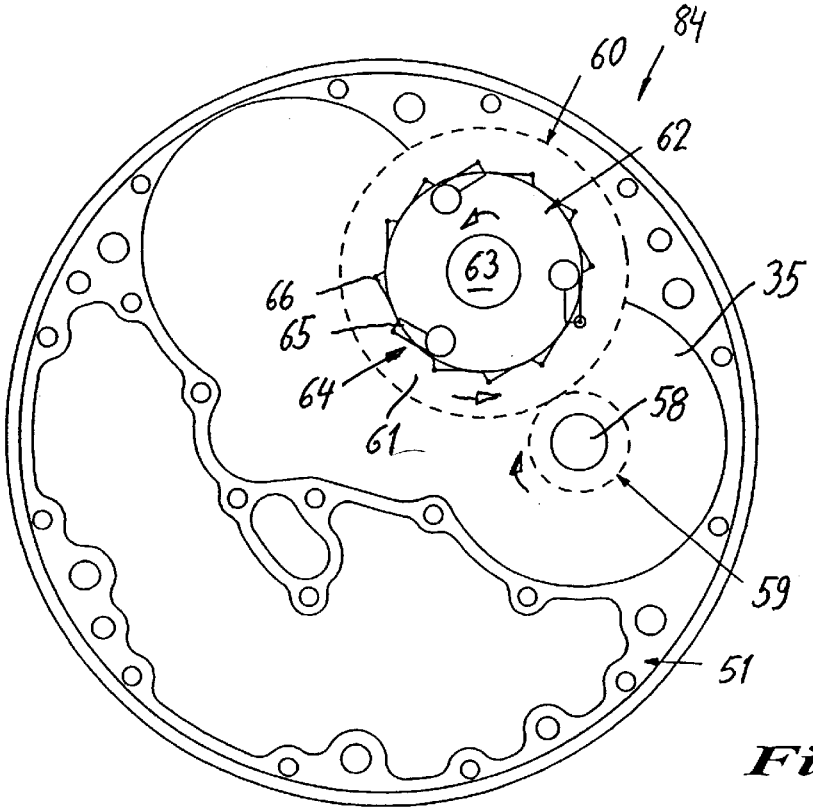

The motor shaft 55 projects through the third gear stage 42 and the upper gear blank 51 into the lower gear blank 50 and is mounted there and is connected in non-rotary manner to a driving pinion 56 engaging in a toothed wheel 57 with a much larger diameter (FIG. 3). In the drawings, the toothed wheels are only indicated by broken line pitch circles. The toothed wheel 57 is mounted in non-rotary manner on the shaft 58, which projects from the first gear plane (blank 50) into the second gear plane (blank 51), which also forms the second gear stage (FIG. 4). It is connected in non-rotary manner there to a pinion 59, which once again drives a larger diameter toothed wheel 60. The toothed wheel 60 has an outer rim 61 provided with teeth and a hub 62 connected in non-rotary manner to a shaft 63.

A retaining pawl freewheel 64 is located between the outer rim 61 and the hub 62. Three spring-loaded pawls 65 arranged in the vicinity of the hub circumference and projecting in inclined manner over the latter engage in inverted, sawtooth-like recesses 66 on the inner circumference of the outer rim 61.

Figure 5:
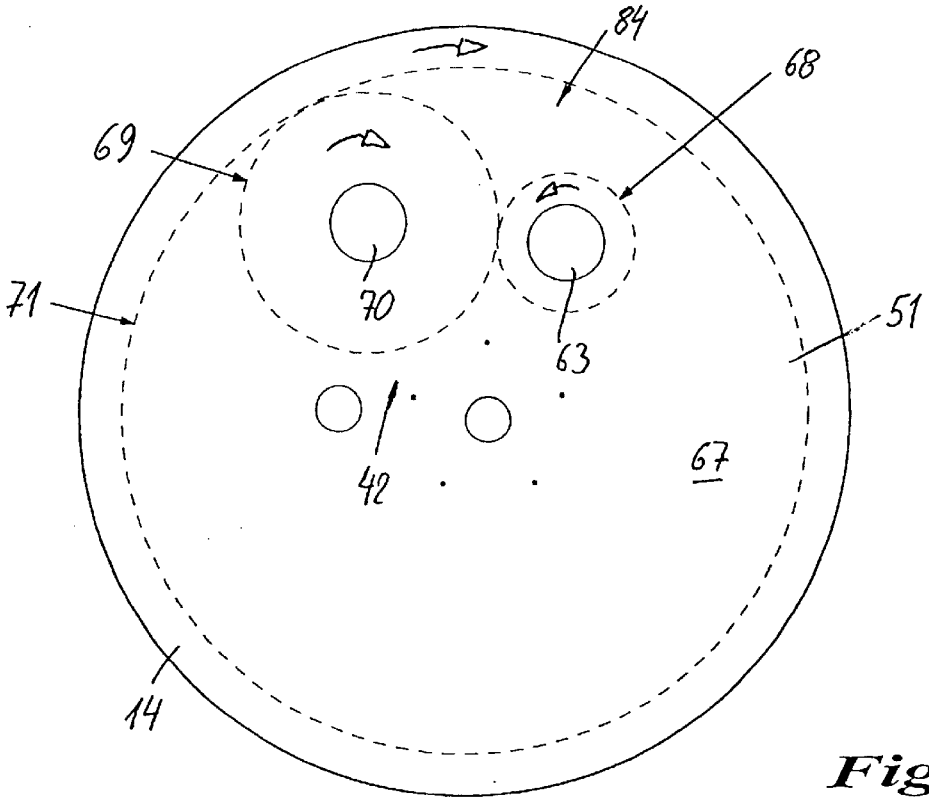

The shaft 63 projects in sealed manner through the upper blank face 67 of the gear blank 51 and carries there in non-rotary manner a pinion 68, which drives an intermediate wheel 69, which is mounted on a shaft 70. It engages in an inner rim 71 on the inner circumference of the winch drum and drives the latter (FIG. 5).

Figure 6:
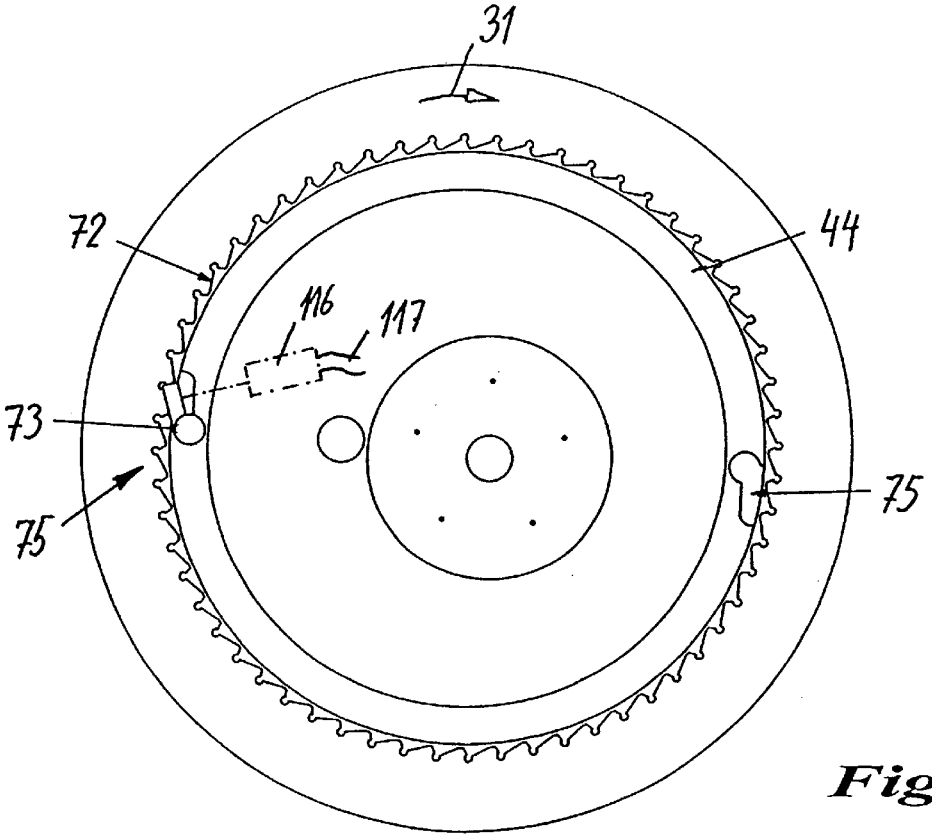

FIG. 6 shows that on the inner circumference of the winch drum is also provided a sawtooth-like negative tooth system 72, in which engage pawls 73 of the same type as described hereinbefore. They are mounted on the supporting body 44 and consequently form a retaining pawl freewheel 75 for the winch drum, which locks the latter against reversal.

A toothed wheel 77 driven by a pinion 76 is also mounted in the first gear stage (FIG. 3). The pinion 76 is provided in non-rotary manner with a driving shaft 98 for mechanical operation and which is connected by means of a square adaptor 99 (FIG. 2) to the winch crank nut 32. The shaft 98 passes through the motor area 47 in parallel, but eccentrically to the winch axis 28, namely close to the supporting body wall 41, so that adequate space for the motor remains in the motor area 47.

The toothed wheel 77 also contains a retaining pawl freewheel 78 and is constructed in the same way as the freewheel 64 from outer rim 70, hub 80, retaining pawls 81 and inner skew teeth 82. The hub is located on the shaft 70 and also drives the intermediate toothed wheel 69.

Figure 9:
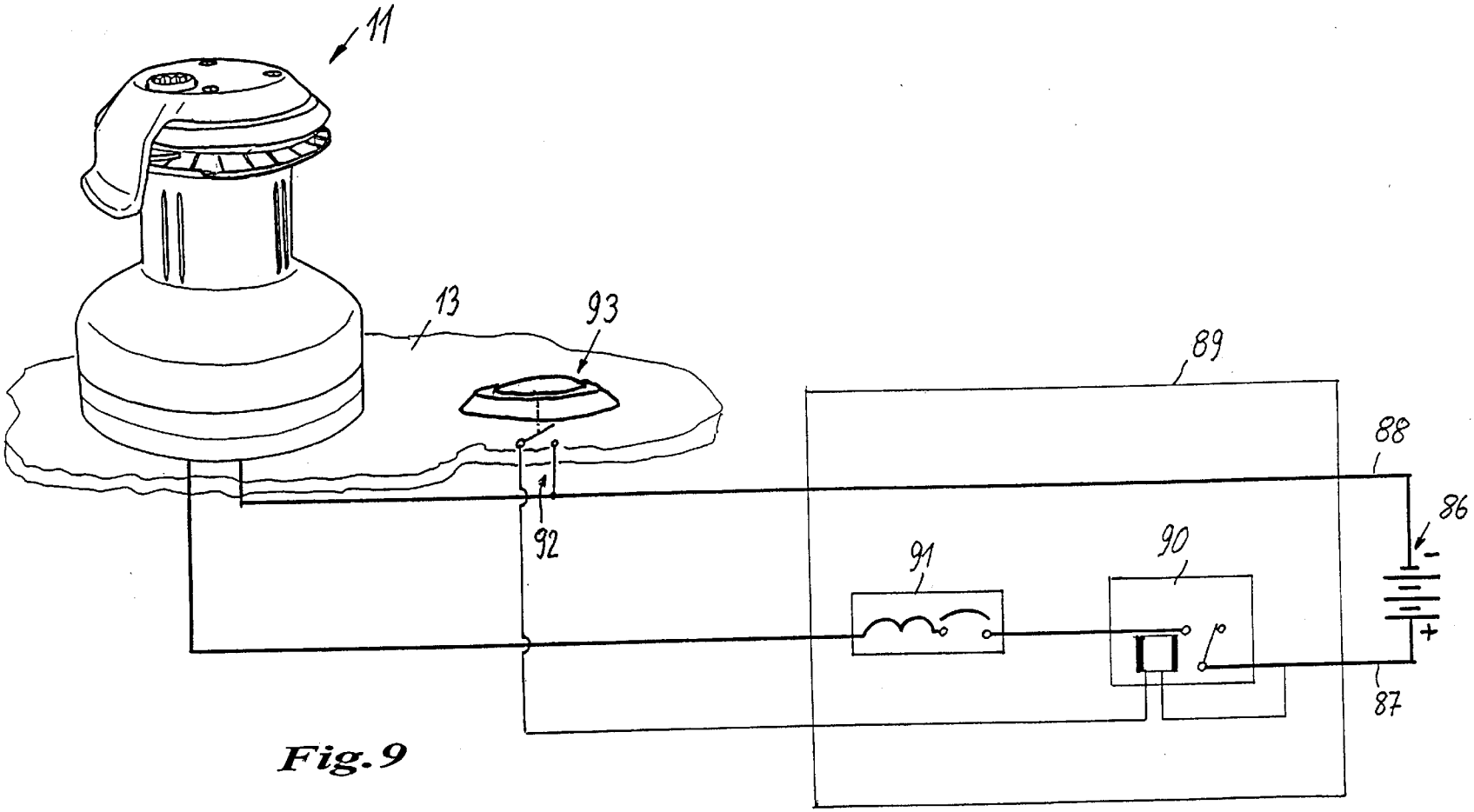
FIGS. 9 and 10 Electric circuit diagrams.
Figure 10:
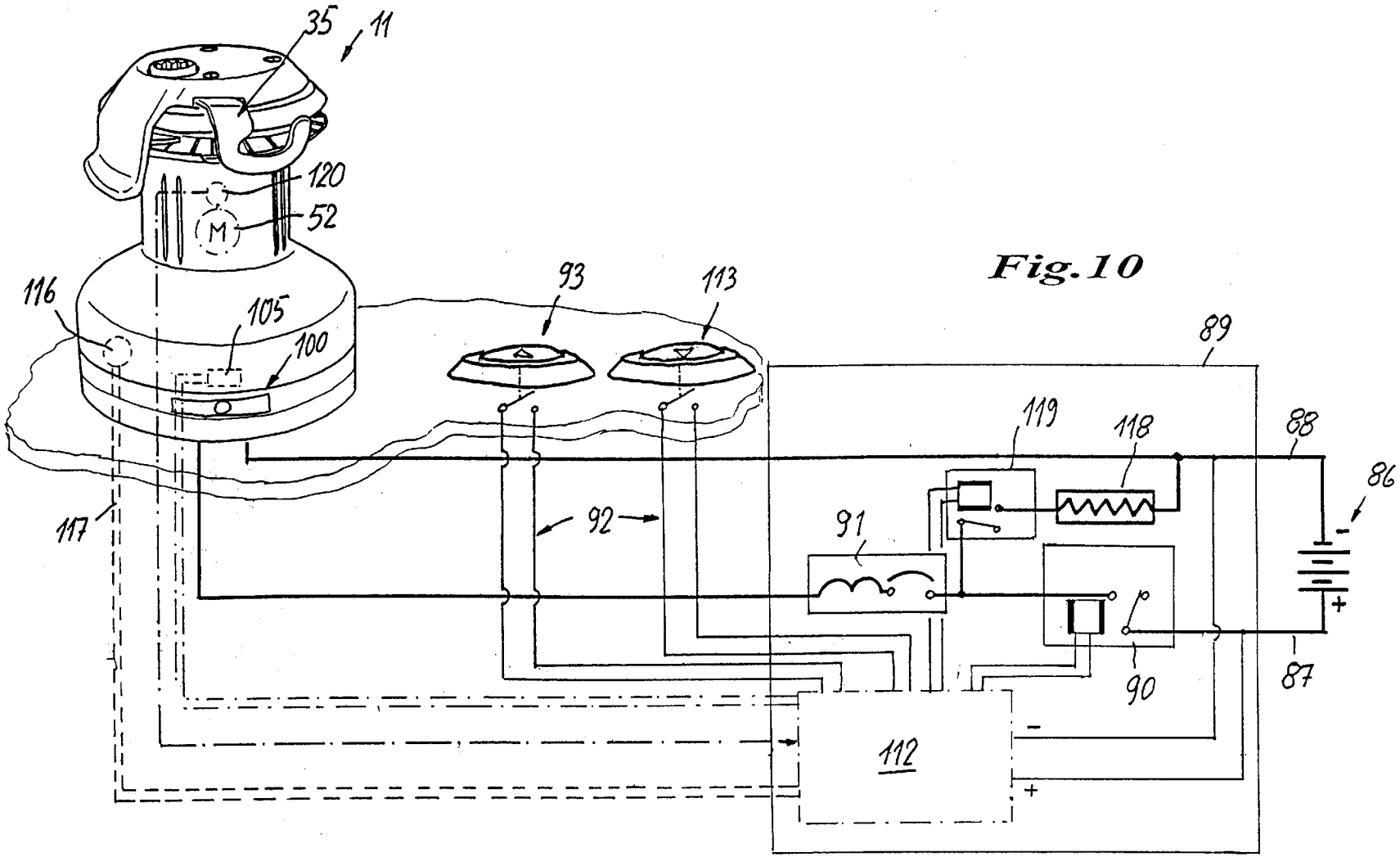
Figure 15:
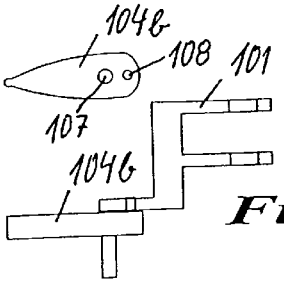
Figure 16:
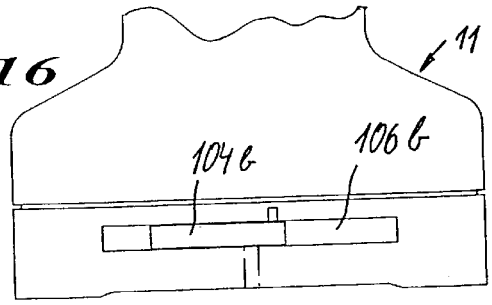

The electrical connection of the winch is diagrammatically shown in FIG. 9. Positive and negative supply lines 87, 88 from a marine battery 86, optionally via master switches and fuses, lead to a control device 89, which contains in the positive line a contactor 90 and an excess current switch 91. Optionally by means of an auxiliary relay, the relay 90 is controlled by a weak current circuit 92 containing an operating switch 93 for the winch. The control device 89 can be located at a suitable point under the deck and the operating switch 93 is preferably a robust pushbutton protected against moisture and optionally by a cover against accidental operation and which is installed on deck in the vicinity of the winch.

The winch functions in the following way. The rope 15 is located around the winch drum in the manner shown in FIG. 1 and is introduced by means of a guide nose into the gripping groove 23. By pulling on the rope end 85 it is possible to haul through the rope in order to e.g. rapidly haul through a sheet after tacking. However, the winch drum can rotate freely in the hauling direction 31, because the retaining pawl freewheel 75 (FIG. 6) runs freely in this direction without any need for the joint running of the gear.

If subsequent motor further hauling is to take place, the operating switch 93 is depressed, the contactor 90 being controlled by means of the control circuit 92. The contactor operates and by means of the excess current switch 91 the motor 52 is started up. By means of the epicyclic gear 54 it drives the shaft 55 (FIG. 2) and consequently the pinion 56 in the first, lower gear stage 50 (FIG. 3). The rotation directions of the gears in the hauling direction 31 are indicated by arrows. By means of the toothed wheel 57 which, together with the pinion 56, forms the first winch gear stage, the shaft 58 and the pinion 59 in the second gear stage (blank 51 in FIG. 4), the toothed wheel 60 is driven. The rotation direction arrow (counterclockwise) reveals that the freewheel 64 is blocked and consequently the hub 62 and shaft 63 are driven. Thus, in the third stage (FIG. 5) the shaft 63 drives the pinion 68 and consequently the intermediate toothed wheel 69, so that the winch drum 14 is rotated in the hauling direction 31 (clockwise).

In the manner described hereinbefore the selftailing device 22 keeps the end of the rope taut, so that it is firmly engaged round the winch drum and the rope is hauled in with considerable tensile forces. The magnitude of this force is on the one hand dependent on how often the rope is placed round the winch drum and is on the other limited by the tensile force of the motor. As a result of the motor characteristics the latter can be so high that there could be a risk for the rope or the rigging (sails) tightly hauled by it if the operating knob is not released in good time. In this case and also in the case of a complete blockage, the motor receives such a high current that the excess current switch 91 trips and stops the motor. The tension of the rope is maintained. If there is a permanent motor overload, the motor 52 contains a thermal motor protector in the form of a bimetallic switch.

After switching off the motor the pawls 73 of the winch drum freewheel 75 again engage in the tooth system 72 formed by the pawl segments and in this way mechanically prevent a reversal of the winch drum, so that the motor and gear train are relieved.

During motor operation the gear train was automatically disconnected for manual operation. Although the shaft 70 (FIG. 3) rotated in the clockwise direction, the freewheel 78 ensured that the toothed wheel 79 did not co-rotate. Correspondingly the pinion 76 and driving shaft 98 were stationary. A winch crank mounted accidentally on the winch crank nut 32 does not co-rotate, which could otherwise have led to an accident risk.

If the winch crank is operated (counterclockwise), the toothed wheel 79 is rotated clockwise (cf. the broken line direction arrows in FIG. 3). Thus, the freewheel 78 is locked again and the shaft 70 is driven clockwise, i.e. in the hauling direction 31. Thus, the winch drum 14 can be manually rotated with a speed reduction corresponding to the toothed wheels 76 and 79.

There is no need for a co-rotation of the motor gear train, because in the case of a stationary or slowly rotating motor the freewheel 64 allows the free running of the toothed wheel 60 when driving the hub 72 counterclockwise.

As a result of this automatic "transfer" between the two drive types it is even possible to "help" in the case of motor operation with the winch crank, without having to fear mechanical damage or accident hazards.

Through the exclusive use of spur gears and the placing thereof in an oil bath the gear efficiency is very high. Together with the use of a high speed motor and the marked speed reduction, high tensile forces can be produced with a small motor. Speed reduction is assisted by the fact that the inner rim 71 transferring the rotary force to the winch drum is close to the largest diameter of said drum, whereas the effective winch drum face 16 has a smaller diameter.

If in the case of this construction the rope is to be completely slackened, it is moved out of the gripping groove 23 and the end is left loose, so that the coils relax on the winch drum and free the rope. This can also take place if the rope is only slightly loosened or the rope tension is to be reduced somewhat. In this case the operator must very carefully release the rope end and then retighten it and place it in the gripping groove of the selftailing device 22 in order not to loosen excessively.

An extended embodiment of the master winch according to the invention illustrated by means of FIGS. 10 to 23 makes it possible to carry out the veering or easing away of the rope in motor manner.

In the vicinity of the winch this embodiment has the same construction as that described up to now, but with the following additions.

Veering or easing away when the tensioned rope can be loosened or slackened, must take place in controlled manner. A jerky, uncontrolled slackening is unusable e.g. for trimming the sails. Thus, in this construction the motor is used as a brake. Thus, on reversing the winch drum 14 in the veering direction 39 (FIG. 1) it is also driven in the opposite direction. The freewheel 64 permits this reversal, because it remains engaged.

To ensure that when winding off a winch crank mounted on the winch crank nut undesirably co-rotates, the gear construction is modified in the manner shown in FIGS. 11 to 22.

They show three different versions of an engaging mechanism 100 for the mechanical drive. It is common to all these versions that in place of the freewheel 78 use is made of a manually operable switching lever 101, which is pivotably mounted about the manual driving spindle 98. The pinion 102 located on said shaft drives an intermediate pinion 103, which is freely rotatably mounted on the switching lever. The switching lever is constructed in the form of a forked lever (cf. FIGS. 11, 15 and 19), the pinions 102 and 103 running between the two forks.

The switching lever 101 can be engaged (FIGS. 13, 17 and 21) or disengaged (FIGS. 14, 18 and 22) with the intermediate wheel 69 driving the winch drum by means of an operating handle 104. Thus, not only is there no need for the freewheel 78, but also the toothed wheel 79. To ensure that the motor operation of the winch in both directions is only possible if the mechanical drive is disconnected, a microswitch 105 is provided, which is located in the control circuit and only closes the control circuit when the mechanical drive is disconnected and consequently permits the electric winch functions.

To this extent the functions of all three embodiments according to FIGS. 11 to 14, 15 to 18 and 19 to 22 are identical. What is different is the nature of the mechanical operating handle 104 and the arrangement thereof.

In the construction according to FIGS. 11 to 14 the operating handle is constructed as a spring plate 104*a*, which projects out of the winch foot through a cutout 106*a* and is pivotable between the position shown in FIGS. 13 and 14. Under its spring tension it locks in upper locking depressions which fix the two end positions. For operation purposes the spring plate is pressed down and can then be pivoted. An operating knob can be provided on the spring plate.

Figure 17:
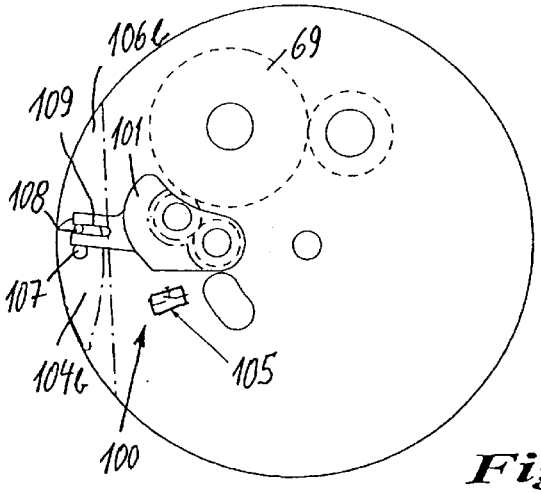
Figure 18:
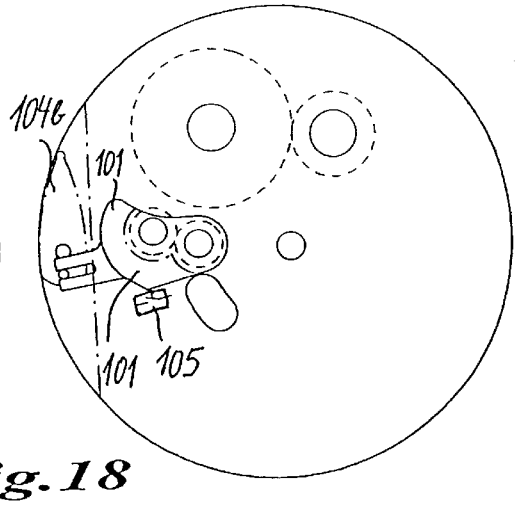
Figure 19:
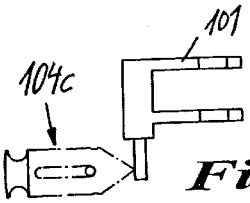
Figure 20:
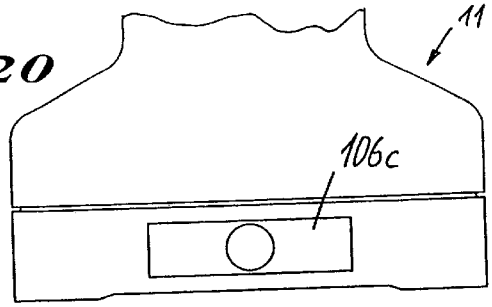
Figure 21:
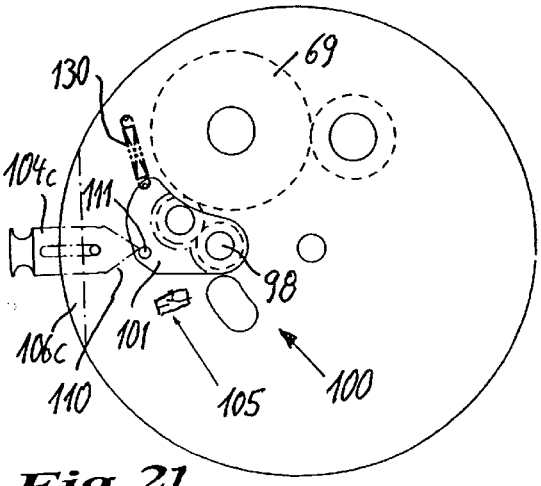
Figure 22:
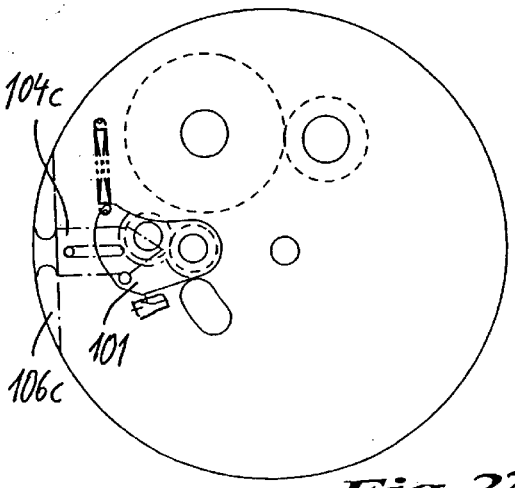

For pivoting the lever 101, the construction according to FIGS. 15 to 18 has a separate, streamlined operating lever 104*b,* which is pivotably mounted about an axis 107 by approximately 180° within a segment cutout 106*b.* driving pin 108 rotates in a fork nut 109 on the lever 101 and pivots the lever between the position shown in FIGS. 17 and 18. This construction creates a large speed increase for the operation ensuring that the operating lever 104*b* can indeed be engaged by the cutout 106*b,* but does not project over the winch circumference and simultaneously ensures a locking in the end positions, because particularly if the operating handle is pivoted by somewhat more than 180° which is possible when placed in the segmental groove, a self-locking occurs.

The construction according to FIGS. 19 to 22 has an operating handle 104*c* in the form of an operating knob which, in the unoperated state (manual drive disconnected) is countersunk in a segmental cutout 106*c* (FIG. 22), but can be gripped and drawn out, so that an inclined face 110 on the operating handle 104 together with a pin on the lever 101 releases the latter for engagement in the toothed wheel 69. The pivoting of the lever can be brought about by a spring 130. In addition, in all versions, an additional contact force between the toothed wheels 103 and 69 is produced in that the reaction forces acting thereon bring them together.

The motor winch with veering device operates in the following way. For hauling purposes the winch operates in the above-described manner for motor operation. If the winch is to be operated manually, which only takes place in the hauling direction, by means of the engaging mechanism 100 described by means of FIGS. 11 to 22, the manual gear train is connected and by rotating the winch crank clockwise the shaft 98, pinions 102 and 103 and the intermediate wheel 69 rotate the winch drum. In this state the microswitch 105 is open and consequently motor operation is impossible. The motor is not co-rotated due to the freewheel 64.

The veering function is controlled by an electron sequence control using a logic module (EPROM). The latter is integrated into a control device 112, which is diagrammatically shown in FIG. 10 and is located in the control unit 89. Apart from the circuit components shown in FIG. 9, the following additional components are present for this function. An operating switch 113 for the veering function and belonging to the control circuit, the already described microswitch 103 on the engagement mechanism for mechanical operation and an electromechanical disconnecting device for the winch drum freewheel 75 are all additionally provided. As is shown in broken line form in FIG. 6, the freewheel 75 comprises control circuit-controllable electromagnets or servomotors, which can return the pawls 79 of the winch drum freewheel counter to their spring tension and can therefore free the winch drum 14 for rotation in both directions. The control 116 takes place by means of control lines 117.

Within or outside the control unit 89 is provided a brake resistance means 118, which closes the motor circuit by means of a contactor or relay 119 controllable by the control device 112.

The sequence is now as follows. If the reverse operating switch 113 is now operated, then by means of the control device 112 the motor is started in the hauling direction in order to loosen the hitherto loaded and consequently locked pawls 73 of the winch drum 14. The motor is started by means of preset speed pulses controlled by means of a pulse generator on the motor. The pawls 73 of the winch drum freewheel 75 (FIG. 6) are disengaged by means of the disconnecting devices 116 and are secured in this position.

The motor is again switched dead. Under the tension of the rope the winch drum now starts to rotate in the veering direction 39. The motor is also driven and rotates in the opposite direction to its normal rotation direction until a preset winding off speed is reached. The latter is monitored by means of the pulse generator 120 on the motor or in the gear train. On reaching the winding off speed the relay 119 is closed, so that now the resistor 118 is supplied by the motor acting as a generator and consequently the motor acts as a motor brake. Thus, the winch drum rotates in braked rearwards manner with a controlled speed. Optionally by a corresponding control or e.g. the choice of different resistors, the winding back speed could be adjusted.

For ending the veering process the knob of the operating switch 113 is released. Then, controlled by means of the control device 112, the motor is briefly switched on again until as a result of the motor now operating in the forwards direction the backward rotation is decelerated and the drum rotation direction is in the reversal process, i.e. moves towards zero. This is indicated by the pulse generator to the control device, which ensures that the magnets or servomotors of the disconnecting device 116 again free the pawls 73, so that under their spring tension they can drop into the drum teeth 72 and secure the drum again. The winding off process is then ended. As a result of the braking of the reverse rotation, the process is not suddenly interrupted and the drum is not suddenly stopped by the pawls from the reverse rotation operation, which could lead to wear or damage.

As has already been stated in connection with FIG. 1, during the veering process the retaining device 34 maintains the rope 15 in the gripping groove 23 of the selftailing device 22, even during reversal and prevents the freeing of the rope end and releases the winding round the winch drum. Thus, during veering it is ensured that the rope tension does not suddenly collapse and after veering the rope is again ready for hauling.

Thus, the invention creates a winch, which is in particular suitable as a sheet or halyard winch for sailing yachts, etc. It has an integrated electric or hydraulic drive, the motor being integrated into the winch in such a way that it is located within the winch body and in particular within the winch drum. By means of a multistage gear in the winch foot and optionally assisted by an epicyclic gear in the motor, it brings about the rotation of the winch drum. A manual operation of the winch crank is possible through a winch crank nut in the winch head, the manual driving shaft running past the somewhat eccentrically positioned motor.

A reverse rotation or veering function can be provided, in which following the disconnection of the drum locking mechanism the motor is rotated back in decelerated manner with a controlled speed.

What is claimed is:

1. A winch for ropes, having:

a winch drum (14) rotatable at least in a hauling direction (31);

a winch foot for fitting the winch to a base part (13);

a winch gear (84); and a motor (52) located at least partly in a motor area (47) surrounded by the winch drum (14) and driving the winch drum (14) by means of the gear (84), wherein the motor area (47) is provided in a substantially tubular supporting body (44) on which the winch drum

(14) is mounted rotatable around a drum rotation axis (28) by means of bearings (46), the motor (52) having a motor axis and being mounted on the supporting body (44) with the motor axis (53) parallel to the rotation axis (28) of the winch drum (14).

2. A winch for ropes, having:

a winch drum (14) rotatable at least in a hauling direction (31);

a winch foot for fitting the winch to a base part (13);

a winch gear (84);

a motor (52) located at least partly in a motor area (47) surrounded by the winch drum (14) and driving the winch drum (14) by means of the gear (84); and a manual drive having a driving shaft (98) passing alongside the motor (52) which motor is eccentrically located in the motor area (47).

3. Winch according to claim 2, wherein the manual drive is operable by means of a winch crank from a coverlike winch head (29) covering the winch drum (14).

4. A winch for ropes, having:

a winch drum (14) rotatable at least in a hauling direction (31);

a winch foot for fitting the winch to a base part (13);

a winch gear (84);

a motor (52) located at least partly in a motor area (47) surrounded by the winch drum (14) and driving the winch drum (14) by means of the gear (84); and a selftailing device (22) tightening the rope (15) running off the winch drum (14) during hauling, the selftailing device (22) being positioned close to the free end of the winch drum (14) and has a circumferential gripping groove (23), the gripping groove (23) having first and a second gripping bodies (24, 25) having variable spacing from each other in an axial direction to the winch drum (14).

5. Winch according to claim 4, wherein the first gripping body (24) is a flange of the winch drum (14) and the second gripping body (25) is a circular disk (25) being axially movable relatively to the first gripping body to form a gripping groove of variable width.

6. Winch according to claim 1, wherein the motor is an electric geared motor (52) with an integrated motor gear serving as a gear prestage, which reduces the speed of the motor by three to five times prior to introduction into the winch gear (84).

7. Winch according to claim 6, wherein the motor is a DC shunt-wound motor, which has an idling speed of above 10,000 r.p.m.

8. Winch according to claim 2, wherein the winch gear (84) and a motor gear (54) are non-self-locking spur gears, the winch gear (84) running in a maintenance-free oil bath.

9. Winch according to claim 2, wherein the winch gear (84) is located in the winch foot (12) and contains three gear planes, each plane comprising a gear stage and containing at least two disk-like, superimposed stacked blanks (50, 51).

10. Winch according to claim 2, further comprising an electric, manually operable control (89), which has at least one contactor (90) and an excess current fuse (91) for limiting the maximum tensile force exerted to the rope (15).

11. A winch for ropes, having:

a winch drum (14) rotatable at least in a hauling direction (31);

a winch foot for fitting the winch to a base part (13);

a winch gear (84);

a motor (52) located at least partly in a motor area (47) surrounded by the winch drum (14) and driving the winch drum (14) by means of the gear (84); and at least two of the following freewheel mechanisms:

a winch drum freewheel mechanism (75), which allows a rotation of the winch drum (14) in the hauling direction (31), but prevents a reverse rotation (39) counter to the hauling direction;

a first gear freewheel mechanism (64), connected in a gear train between the motor and a manual drive, said first gear freewheel mechanism (64) disconnects the motor (52) from the winch drum in the case of manual operation;

a second gear freewheel mechanism (78) located in the manual drive and disconnecting the manual drive during motor operation.

12. Winch according to claim 1, wherein the winch drum (14) is rotatable in the hauling direction (31) and also in a reverse direction (39), and further comprising:

a winch drum freewheel mechanism (75), which, if in action, allows rotation of the winch drum (14) in the hauling direction (31), but prevents reverse rotation (39) counter to the hauling direction;

a veering device using the motor (52) as a brake; and means (116) for controlled inactivating the winch drum freewheel mechanism (75);

whereby the winch drum (14) can be rotated in both rotation directions and controlled loosening of a tensioned rope (15) is possible.

13. A winch for ropes having:

a winch drum (14) rotatable in a hauling direction (31) and also in a reverse direction (39);

a winch drum freewheel mechanism (75), which, if in action, allows rotation of the winch drum (14) in the hauling direction (31), but prevents reverse rotation (39) counter to the hauling direction;

a motor driving the winch drum (14);

a veering device using the motor (52) as a brake;

means (116) for controlled inactivating the winch drum freewheel mechanism (75); and an electric control device (112) to operate the inactivating means (116) and the motor (52), whereby the winch drum (14) can be rotated in both rotation directions and controlled loosening of a tensioned rope (15) is possible.

14. A winch for ropes having:

a winch drum (14) rotatable in a hauling direction (31) and also in a reverse direction (39);

a winch drum freewheel mechanism (75), which, if in action, allows rotation of the winch drum (14) in the hauling direction (31), but prevents reverse rotation (39) counter to the hauling direction;

a motor driving the winch drum (14);

a veering device using the motor (52) as a brake;

means (116) for controlled inactivating the winch drum freewheel mechanism (75); and a manually operable engaging mechanism (100) for coupling a manual drive of the winch to the winch drum (14) and to disconnect the manual drive from the winch drum during motor operation, whereby the winch drum (14) can be rotated in both rotation directions and controlled loosening of a tensioned rope (15) is possible.

15. A winch for ropes having;

a winch drum (14) rotatable in a hauling direction (31) and also in a reverse direction (39);

a winch drum freewheel mechanism (75), which, it in action, allows rotation of the winch drum (14) in the hauling direction (31), but prevents reverse rotation (39) counter to the hauling direction;

a motor driving the winch drum (14);

a veering device using the motor (52) as a brake;

means (116) for controlled inactivating the winch drum freewheel mechanism (75);

whereby the winch drum (14) can be rotated in both rotation directions and controlled loosening of a tensioned rope (15) is possible, wherein the inactivating means (116) comprises an electric drive for raising of pawls (73) of a pawl locking mechanism forming the freewheel mechanism (75).

16. Winch according to claim 13, wherein the motor (52) can be rotated back by the winch drum (14) backwards rotation under the tension of the rope (15); and wherein the control device (112) contains a brake resistance means (118), which is engaged by the control device (112) at a preset reverse speed.

17. Winch according to claim 13, wherein the control device (112) controls the motor to be driven in the hauling direction (31) until the winch drum (14) is almost stationary, after which it causes the inactivating means (116) to engage the freewheel mechanism (75) to prevent reverse rotation of the winch drum.

18. Winch according to claim 1, wherein the winch drum has groups of ribs on its outer face (16) serving as a contact face to the rope, the groups of ribs (17) arranged substantially parallel to the winch drum axis (28), the ribs within each group arranged close to each other in a circumferential direction of the winch drum, with the groups of ribs more distantly spaced from each other in the circumferential direction.

19. Winch for ropes (15), for running rigging on sailing vessels, having a winch drum (14) rotatable at least in a hauling direction (31), a winch foot for fitting the winch to a base part (13), a winch gear (84), a motor (52), being located at least partly in a motor area (47) surrounded by the winch drum (14) and driving the winch drum (14) by means of the gear (84), the motor area (47) being provided in a substantially tubular supporting body (44) on which the winch drum (14) is mounted rotable around a drum rotation axis (28) by means of bearings (46), the motor (52) having a motor axis and being mounted on the supporting body (44) with the motor axis (53) parallel to the rotation axis (28) of the winch drum (14), a manual drive having a driving shaft (98) passing alongside the motor (52) which is excentrically located in the motor area (47), and a selftailing device (22) tightening the rope (15) running off the winch drum (14) during hauling.

* * * * *